US005802624A

United States Patent [19]

Brantman

[11] Patent Number: 5,802,624

[45] **Date of Patent: *Sep. 8, 1998**

[54] SECTIONAL TOILET SEAT

[76] Inventor: Robert F. Brantman, 1400 Waukegan Rd., Lake Forest, Ill. 60045

[ * ] Notice: The term of this patent shall not extend beyond the expiration date of Pat. No. 5,542,131.

[21] Appl. No.: 666,971

[22] Filed: Jun. 20, 1996

Related U.S. Application Data

[62] Division of Ser. No. 324,788, Oct. 18, 1994, Pat. No. 5,542,131.

[51] Int. Cl.[6] ..... A47K 13/00

[52] U.S. Cl. ..... 4/239; 4/254

[58] Field of Search ..... 4/235, 237, 239, 4/254, 450, 457, 480, 483, 667, 420

[56] References Cited

U.S. PATENT DOCUMENTS

| | | | |
|---|---|---|---|
| 72,634 | 12/1867 | Heywood | 4/237 |
| 195,514 | 9/1877 | Kutscher | 4/237 |
| 543,180 | 7/1895 | Febiger | 4/237 |
| 937,164 | 10/1909 | McAuliffe | 4/237 |
| 956,410 | 4/1910 | Philpot | 4/237 |
| 1,028,152 | 6/1912 | Treude | 4/237 |
| 1,408,903 | 3/1922 | Newman | 4/237 |
| 1,438,491 | 12/1922 | Hilpert | 4/239 |
| 1,668,242 | 5/1928 | Griffith | 4/254 |
| 2,094,498 | 9/1937 | Saunders | 4/239 |
| 2,550,221 | 4/1951 | Calderon | 4/237 |
| 2,720,658 | 10/1955 | Lea | 4/239 |
| 3,341,867 | 9/1967 | Keen | 4/239 |
| 5,136,731 | 8/1992 | Caro et al. | 4/239 |
| 5,267,355 | 12/1993 | Landman | 4/237 |
| 5,542,131 | 8/1996 | Brantman | 4/239 |

OTHER PUBLICATIONS

Homecare, Feb. 1994, p. 70 (magazine advertisement for elevated toilet seat).

*Primary Examiner*—Robert M. Fetsuga
*Attorney, Agent, or Firm*—Brinks Hofer Gilson & Lione

[57] ABSTRACT

A sectional toilet seat and a method of using such a seat by disabled individuals. The toilet seat includes a lower seat member that supports an upper seat member having a removable section, with the removable section constituting less than a majority of the seating surface of the upper seat member. The method involves removing an upper seat section, transferring a person onto the remaining upper seat member and replacing the removed upper seat section while the person is supported by remaining upper seat member.

5 Claims, 4 Drawing Sheets

SECTIONAL TOILET SEAT

This application is a division of application Ser. No. 08/324,788, filed Oct. 18, 1994 U.S. Pat. No. 5,542,131.

FIELD OF THE INVENTION

This invention relates to aids for the disabled, and more particularly to toilet seats for use by invalids and non-ambulatory persons. Specifically, this invention relates to a toilet seat with a removable section.

BACKGROUND OF THE INVENTION

Those with lower extremity disabilities often have difficulty moving from one location to another. Oftentimes these people are confined to a wheelchair and require assistance to transfer from the wheelchair to a bed, a tub, or a toilet. The transfer to a toilet may be so difficult for some, that rather than assist the disabled individual to a normal position on the toilet, it is easier for the caregiver to deal with a bedpan. This is just one of the major indignities associated with becoming disabled.

There are numerous devices available to assist individuals with reduced mobility to use the toilet. For the most part, these devices raise and lower the toilet seat to assist the individual in moving from a standing position to a sitting position and back again. However, these devices do not assist the disabled individual who no longer can stand or walk.

Presently, transfer boards can be used to assist in transferring such disabled persons to a toilet. These boards relieve some of the burden on the caregivers by eliminating the need to lift and carry the patient from the wheelchair to the toilet. One end of a transfer board is typically placed under the buttocks of the patient on the wheelchair while the other end is placed on top of a toilet seat. The caregiver then drags the patient across the board. The caregiver then lifts the patient up, removes the board, and places the patient on the toilet seat.

This transfer process has been eased considerably with the invention of a sliding transfer device. U.S. Pat. No. 5,282,284 to Brantman, Feb. 1, 1994, discloses a transfer device that allows the patient, even heavy patients, to slide with relative ease from one body support to another body support. Nevertheless, the transfer to a toilet is still somewhat difficult because of the limited space and crowded areas where toilets are usually located. Even with a sliding transfer device, the caregiver must lift the patient and temporarily shift them in order to remove the transfer device. This lifting and shifting is frequently so difficult and uncomfortable for both the patient and the caregiver that the transfer is not even attempted. Typically, the greatest difficulty is found with the disabled in home situations where the spouse, who is often elderly, is the caregiver. The caregiver and patient must resort to using a bed pan, which is a non-private and undignified experience.

Therefore, there is a need for a toilet seat that may readily accommodate a transfer device. Also, there is a need for a toilet seat that permits the patient to be positioned on the seat and the transfer device easily to be removed without the strain on both the patient and caregiver associated with lifting the patient off of the transfer device. Also, there is a need for a version of such a specially adapted toilet seat to be portable so that it may be used along with portable transfer devices in public facilities. These and other needs are solved by the sectional toilet seat described below.

SUMMARY OF THE INVENTION

The present invention is directed to a toilet seat that has a lower seat member attached to an upper seat member which includes at least one removable section. The removable section constitutes less than a majority of the upper seat member seating surface. The present invention also relates to a toilet seat having a smaller section pivotably connected to a larger U-shaped section, wherein the smaller section fits within the gap of the U-shaped section. The present invention also includes a method for using such a toilet seat whereby a section of the upper seat member is removed, a person is transferred onto the remaining upper seat member and the removed upper seat member section is replaced while the person is supported by the remaining upper seat member.

DETAILED DESCRIPTION OF THE PRESENTLY PREFERRED EMBODIMENTS

Figure 1:
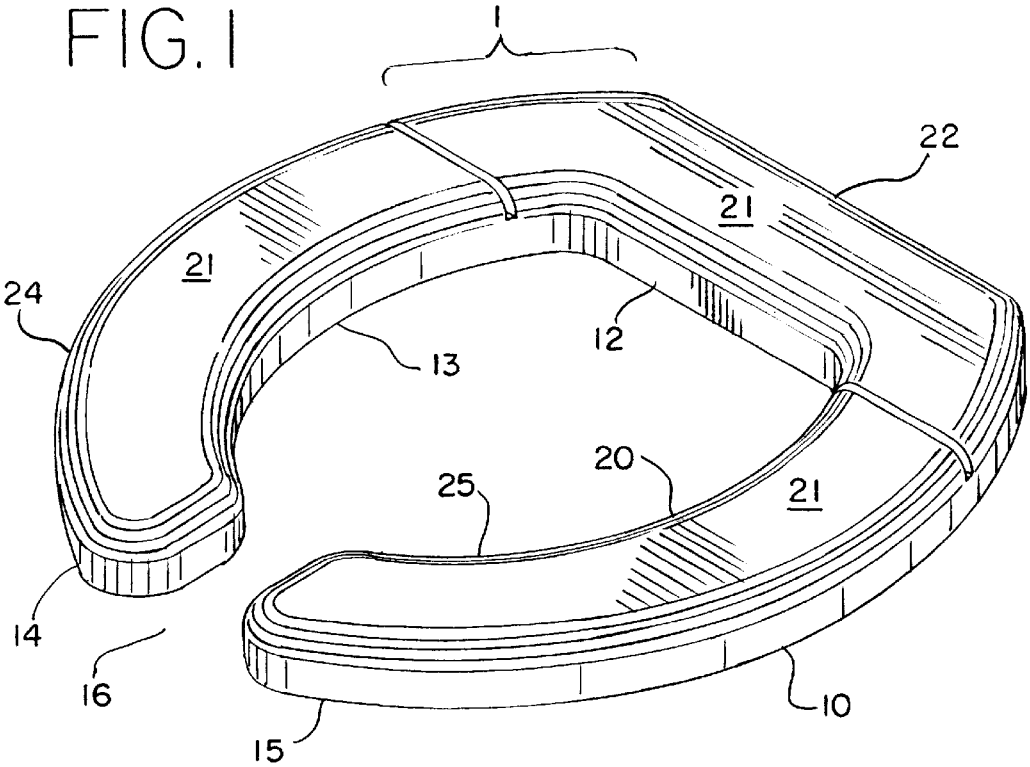
FIG. 1 is a perspective view of an embodiment of a sectional toilet seat.
Figure 2:
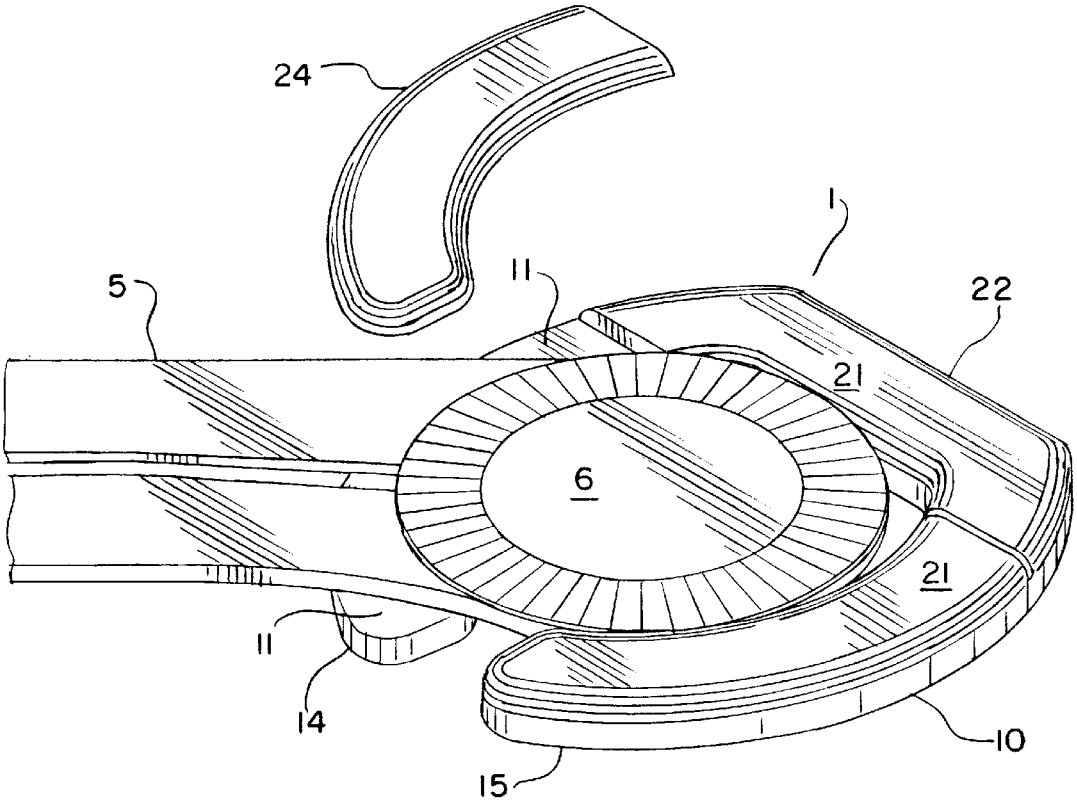
FIG. 2 is a perspective view of the embodiment of FIG. 1 with a section of the upper seat member removed depicting the use of the toilet seat with a transfer device.

FIGS. 1 and 2 illustrate one embodiment of the present invention. The toilet seat 1 includes a lower seat member 10 and an upper seat member 20. The lower seat member 10 is generally U-shaped. The upper seat member has a matching U-shape so that the top surface 11 of the lower seat member 10 is covered by the upper seat member 20. The lower seat member 10 may have hinged attachments (not shown) connected to the rear portion 12 of the lower seat member so that it may be hingedly connected to a toilet bowl (not shown) in any standard fashion practiced in the art. The lower seat member also includes a front portion 13 that has a right arcuate arm 14 and a left arcuate arm 15. The right arm 14 and the left arm 15 are separated by a gap 16. For the purposes of this description and hereinafter, the adjectives "left" and "right" are used from the perspective of an individual seated upon the toilet seat 1.

The upper seat member 20 includes a seating surface 21, a rear section 22 and a two front sections 24 and 25. The rear section 22 is fixed to the rear portion 12 of the lower seat member. The rear section 22 may be integrally formed with the lower seat member 10 or it may be fixedly attached thereto. The two front sections 24 and 25 each cover the right arm 14 and left arm 15 of the lower seat member 10, respectively. The right front section 24 is removably disposed on the lower seat member 10. The right front section 24 covers the top surface 11 of the right front arm 14 of the lower seat member. The left front section 25 is removably disposed on the lower seat member. The left front section 25 covers the top surface 11 of the left front arm 15 of the lower support member 10. The two front sections 24 and 25 are positioned so that the top of the two front sections 24 and 25 are flush with the seating surface 21 of the rear section 22.

To accommodate the use of a sliding transfer device 5 to transfer a patient onto the toilet seat 1, the thickness or height of the right front section 24 is approximately the thickness of the sliding transfer device 5. With the right front section 24 removed, the sliding transfer device 5 may be supported on the top surface 11 of the lower seat member 10 with the result that the seat 6 of the sliding transfer device will be flush with the seating surface 21 of the remaining sections 22 and 25 of the upper seat member 20.

The present invention requires at least one of the front sections 24 and 25 of the upper seat member 20 to be removably disposed on the lower seat member 10. Depending on the position of the toilet with respect to the bathroom or toilet stall, the side from which the toilet may be accessed will dictate the requirements for the section or sections which need to be removable. As depicted in FIG. 2, the left front section 25 may also be fixedly attached to the lower seat member 10 or integrally formed therewith when the right front section 24 is required to be removably disposed on the lower seat member 10.

The right front section 24 may be attached to the lower seat member in any number of fashions as long as it may still be removably disposed on the top surface 11 of the lower seat member 10. It will be understood by one skilled in the art that different methods of attachment are available that would permit the right front section 24 to be removed in a manner that does not interfere with the patient seated on the toilet seat 1. For example, the right front section 24 may be slidably attached to the lower seat member 10 such that the section 24 may slide outward off of the top surface 11 and then drop downwards to permit placement of a sliding transfer device 5. The section 24 may also be pivotably connected or hingedly connected to the adjacent rear section 22 or the lower seat member 10 in a manner that permits the section 24 to swing out and away from the top surface 11 of the lower seat member. It is also contemplated that the section 24 may be lowered into a hollowed section of the lower seat member 10 to effectively remove the section 24 to a point at or below the top surface 11 of the lower seat member. Likewise, the section may slide into a hollowed portion of an adjacent section of the upper seat member 20. One skilled in the art may readily adapt other known mechanisms to accomplish the same effect of having a removably disposed upper seat member section 24 that is within the scope of this invention.

To facilitate the transfer of the patient onto the toilet seat 1, it is important that there be sufficient seating surface 21 remaining in position after the right front section 24 is removed. It should be understood that the patient must place their full body weight on the remaining seating surface 21 as the sliding transfer device 5 is removed or replaced underneath them. Therefore, it is preferred that the removable section 24 constitute less than a majority of the seating surface 21 of the upper seat member. More preferably, the removable section 24 should constitute less than 40 percent of the total seating surface 21 of the upper seat member 20. On the other hand, sufficient top surface 11 space on the lower seat member 10 is required to be exposed in order that the sliding device 5 may fit thereon and remain flush with the remaining seating surface 21.

Figure 3:
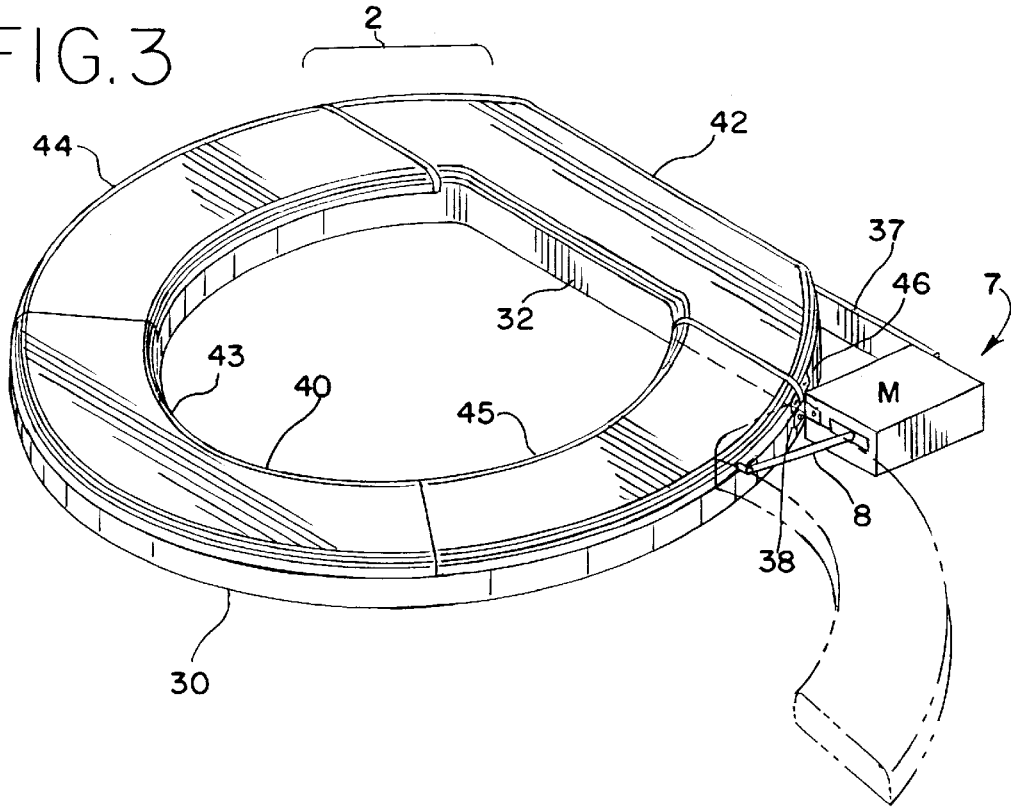
FIG. 3 is a perspective view of another embodiment of the present invention.

Another embodiment of the present invention is depicted in FIG. 3. In this embodiment, the toilet seat 2 and the lower seat member 30 have a substantially oval shape. The upper seat member 40 has a rear section 42 and three sections 43, 44 and 45 that are forward of the rear section 42. The rear section 42 is fixedly attached to the lower seat member 30. The left front section 45 is removably disposed on the lower seat member 30. The right front section 44 and the center front section 43 are removably disposed on the lower seat member 30, but may optionally be fixedly attached thereto.

Figure 7:
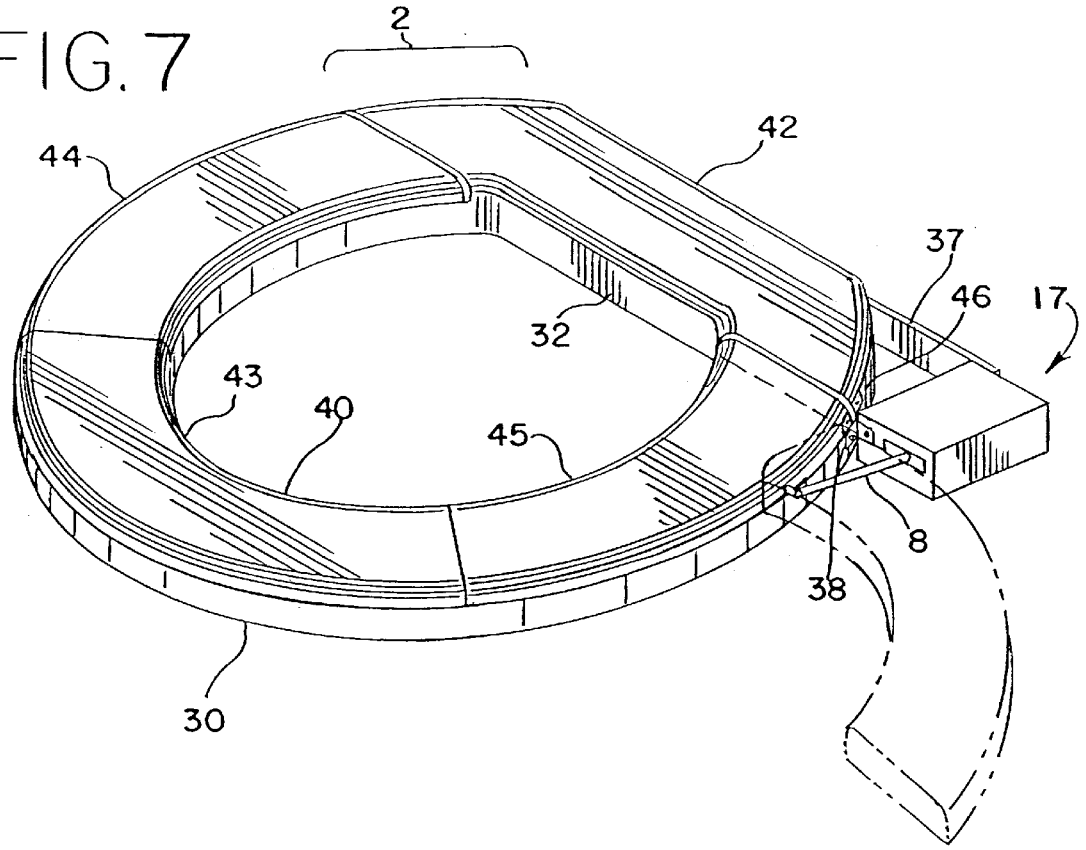
FIG. 7 is a perspective view of another embodiment of the present invention.

It is contemplated that the left front section 45, or any other removable section, may be automatically removed and replaced with a power aid as shown in FIG. 7. For example, this may be accomplished with springs, weights or motors. The embodiment depicted in FIG. 3 includes an electric motor 7 that is operatively connected to the left front section 45 via an arm 8. The electric motor 7 may be battery operated, or may operate with line voltage. The electric motor 7 is fixedly attached to the rear portion 32 of the lower seat member 30 via struts 37 and 38. The left front section 45 is pivotably connected to the rear section 42 via a hinge 46. It will be understood that one skilled in the art may regularly adapt the electric motor 7 in any number of different ways, for example with gears or belts, to accomplish the operation to automatically remove and replace a section 45 of the upper seat member 40.

Figure 4:
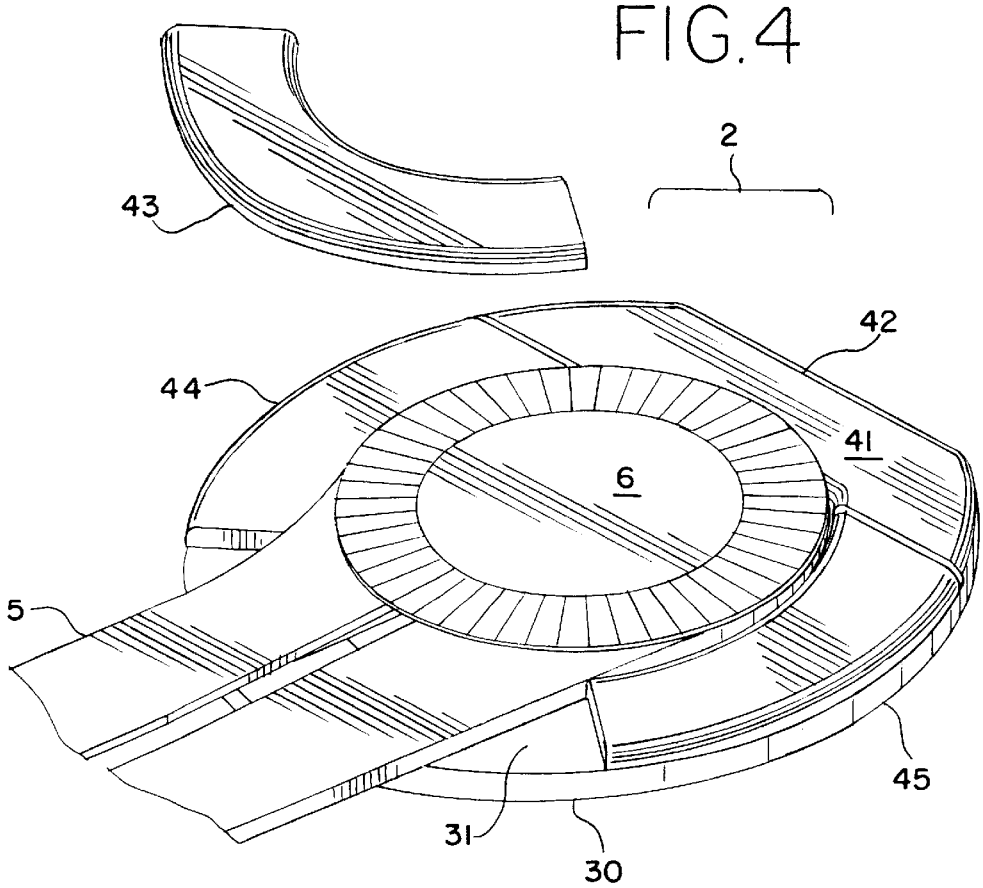
FIG. 4 is a perspective view of another embodiment of the present invention with a section of the upper seat member removed depicting the use of the toilet seat with a transfer device.

FIG. 4 depicts another embodiment of the present invention showing the positioning of a sliding transfer device 5 on the toilet seat 2. The center front section 43 is removed and the top surface 31 of the lower seat member 30 supports one end of a sliding transfer device 5. The center front section 43 is manually lifted away from the lower seat member 30 prior to positioning the sliding transfer device 5 thereon. The thickness of the removable center front section 43 is about the same as the sliding transfer device 5 such that the seat 6 is nearly flush with the seating surface 41 of the upper seat member 40 when the sliding transfer device is supported on the top surface 31 of the lower seat member 30.

Figure 5:
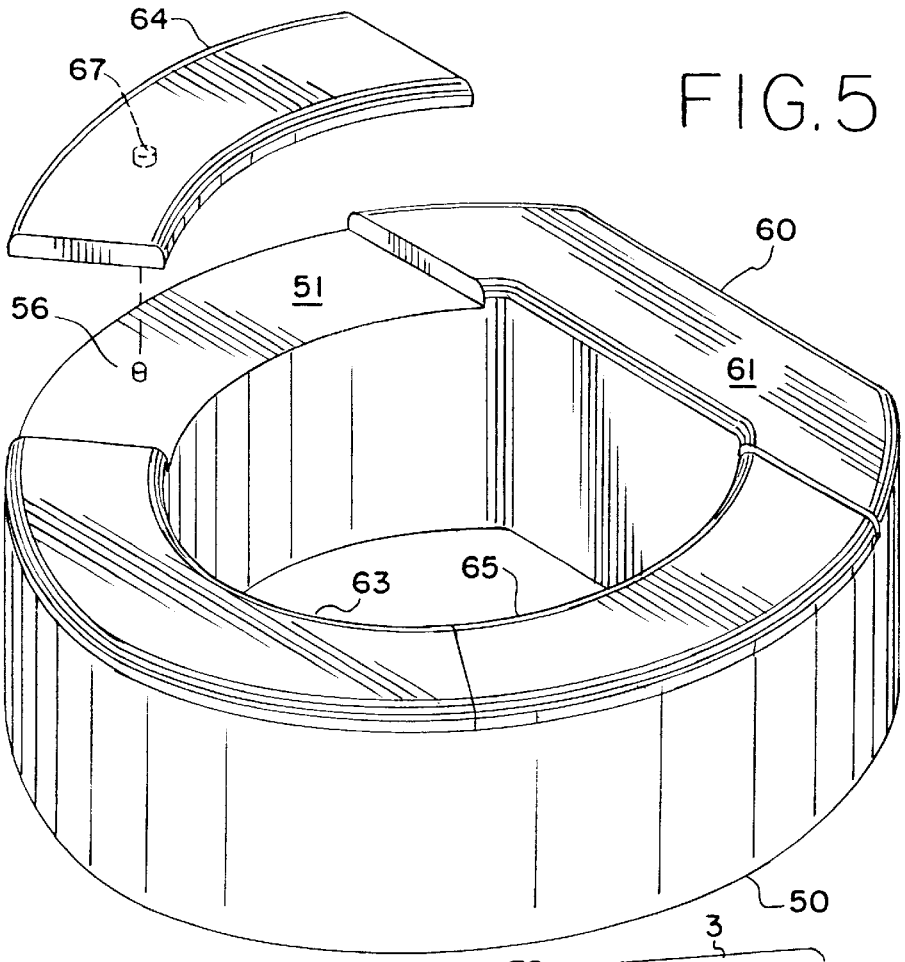
FIG. 5 is an exploded perspective view of another embodiment of the present invention.

FIG. 5 depicts an embodiment of the present invention with an elevated seating surface 61. The seating surface 61 is at an elevation determined by the height of the lower seat member 50. The lower seat member 50 sits on the rim (not shown) of a toilet bowl. Preferably, the lower seat member 50 has a height sufficient to place the elevation of the top surface 51 close to the elevation of the seating surface of a wheelchair from which a patient may be transferred. Typically, a lower seat member 50 with a height of four inches is sufficient to place the top surface 51 above a standard residential toilet bowl rim at a similar elevation as a wheelchair seat. The thickness of the removable right front section 64 of the upper seat member is similar to the thickness of the sliding transfer device 5 in order to keep the seat 6 flush with the seating surface 61. By keeping the top surface 51 at the same height as the wheelchair seat, the sliding transfer device 5 would be substantially level during the transfer operation. A level sliding transfer device 5 eases the transfer of the patient in either direction, from the wheelchair to the toilet seat 2, or back to the wheelchair.

A means for interlocking the removable section 64 of the upper seat member 60 is also depicted in FIG. 5. The lower seat member 50 includes a post 56 extending above the top surface 51. The right front section 64 includes a complementary socket 67 in which the post 56 is positioned when the section 64 is correctly positioned on the top surface 51 of the lower seat member 50. The post 56 and socket 67 combination is appropriate for the embodiment of the present invention shown where the right front section 64 is removed by simply lifting the section 64 off of the top surface 51 of the lower seat member 50. Of course, the post 56 and socket 67 may be located on the opposite seat members with the post 56 depending from the upper seat member 60. One skilled in the art may readily adapt other known means to interlock the seat members.

Figure 6:
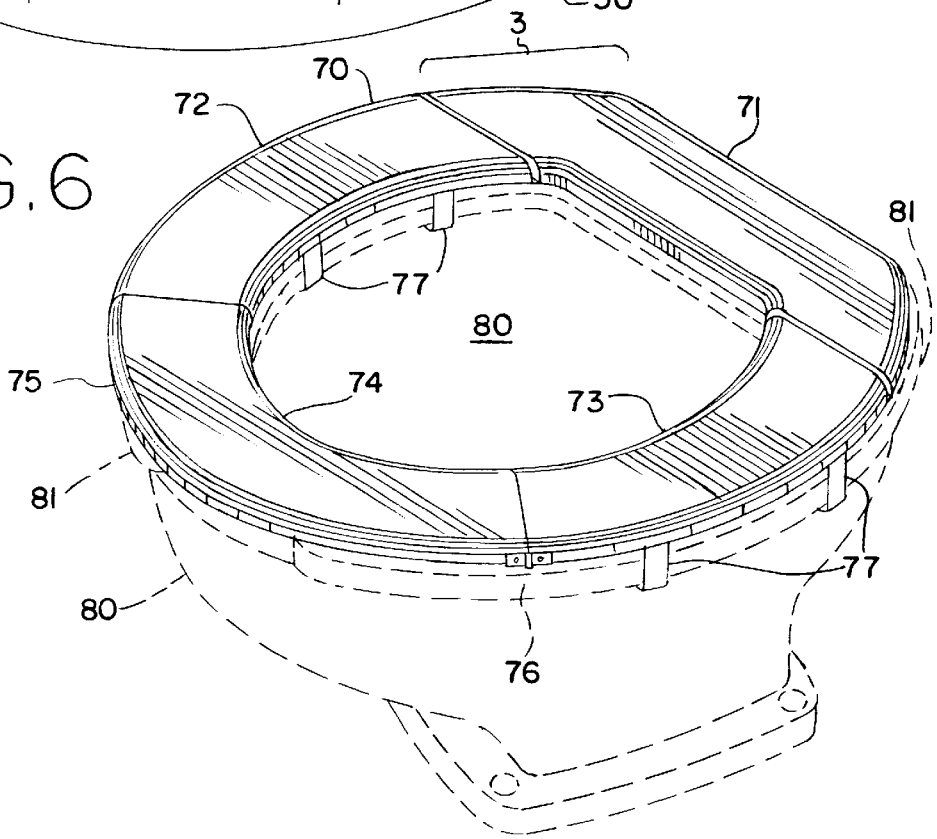
FIG. 6 is a perspective view of another embodiment of the present invention that is portable and is depicted in use with a standard toilet seat.

FIG. 6 depicts yet another embodiment of the present invention that is portable and used with a toilet bowl 80 and its toilet seat 81 in the normal down position. The toilet seat 3 of this embodiment includes a U-shaped rear seat member 70 and an arcuate front seat member 75 that fills the gap 74 in the U-shaped rear seat member 70. The front seat member 75 is pivotably connected to the rear seat member 70 with a hinge 76. This enables the front seat member 75 to swing out of the way to permit a sliding transfer device to be positioned within the gap 74. The sliding transfer device would be supported on the existing toilet seat 81. Although this embodiment of the present invention may also be used by placing it directly on the rim of the toilet bowl 80, it is preferred to place it on top of the toilet seat 81 for sanitary reasons.

The U-shaped rear seat member 70 includes several seat clips 77 positioned along the perimeter to temporarily engage a toilet seat 81 upon which the rear seat member 70 is placed. The clips 77 would hold the rear seat member in position during use. The clips 77 need to be somewhat resilient to be able to snap on and off of the toilet seat 81, yet the clips need to be stiff enough to prevent lateral movement of the rear seat member 70.

The rear seat member 70 is comprised of several smaller sections 71, 72 and 73 that are connected with hinges (not shown). The rear seat member 70 may be folded at the hinges to permit the toilet seat 3 to be collapsed to a smaller size that would make it a comfortable size to carry in a handbag, backpack or other convenient carry-all. The hinge 76, likewise, may be a special two-way folding hinge that would permit the front seat member 75 to fold compactly against the left section 73. Of course, those skilled in the art may regularly adapt known mechanisms to create other methods of collapsing the toilet seat 3 into a smaller size that would still be within the scope of the present invention.

The embodiments of the present invention may be constructed of any number of materials such as, but not limited to, plastic, fiberglass, wood, and metals such as stainless steel, aluminum or specialty metals. A person with ordinary skill in the art may select an appropriate material to meet numerous criteria such as cost, weight, price, strength, user environment, type of transfer device to be used, as well as subjective consumer preferences. It may also be constructed in any thickness as required to accommodate the varying need of the patient.

The present invention includes a method of using a sectional toilet seat. This method is easily described by reference to the toilet seat 1, as depicted in FIGS. 1 and 2, used by a disabled person with the assistance of a caregiver using a sliding transfer device 5. To transfer the disabled person from a wheelchair (not shown) to the toilet seat 1, the front right section 24 of the upper seat member 20 would be removed. One end of the sliding transfer device 5 would be positioned adjacent to the rear section 22 and the left front section 25 of the upper seat member 20. The other end of the sliding transfer device 5 and the seat 6 would be placed under the buttocks of the patient in the wheelchair. Thus, at one end, the sliding transfer device would be supported on the top surface 11 of the lower seat member 10 that was exposed by the removal of the right front section 24, while at the other end, the sliding transfer device would be supported by the wheelchair. The caregiver would slide the patient on the seat 6 across the sliding transfer device and onto the toilet seat 1. Because the seat 6 is nearly flush with the seating surface 21, the patient may then be easily moved and leaned onto the seating surface 21 of the rear section 22 and left front section 25. The sliding transfer device 5 is then removed. The right front section 24 is reattached to the lower seat member 10. The patient may now assume a normal position for a private, dignified toilet experience.

To transfer off the toilet seat 1, the patient leans back onto the rear section 22 and the left front section 25 while the right front section 24 is removed. The end of the sliding transfer device 5 and the seat 6 is then positioned underneath the buttocks of the patient for return to the wheelchair in the reverse of the operation described above.

The method for using a toilet seat 2 as shown in FIG. 3 is similar to that described above except that an electric motor is used to remove and replace the removable seat section. When the electric motor 7 is set to open, the motor 7 retracts the arm 8 and swings the left front section 45 out removing it from its position covering the lower seat member 10. A sliding transfer device 5 is then positioned on the top surface 31 of the lower seat member 30 that is exposed by the prior removal of the left front section 45. The remaining steps are substantially the same as described above except for replacing the upper seat member section 45. After a patient has transferred onto the toilet seat 2 and the sliding transfer device 5 has been removed, the electric motor 7 is set to closed which extends the arm 8 and swings the left front section 45 into position underneath the patient and on the top surface 31 of the lower seat member 30.

The advantage of the present invention is that it eases the burden of transferring a disabled person to and from a toilet. Particularly in home situations where the caregiver is unable to lift the disabled person, the present invention accommodates a transfer device so that substantially no lifting of the disabled person is required to transfer that person to a toilet seat. Therefore, rather than relying upon a bedpan, the disabled person would be able to use the toilet in a seated, dignified and private manner.

Another advantage of the present invention is that it also makes it easier to transfer a disabled person to a toilet in a public restroom. The portable embodiment attaches to the toilet seat of a public toilet and adapts it for use with a transfer device. This allows the disabled person greater mobility outside the home with confidence that their caregiver may easily assist them in using a public restroom facility.

It should be appreciated that the apparatus and method of use of the present invention are capable of being incorporated in the form of a variety of embodiments, only a few of which have been illustrated and described above. The invention may be embodied in other forms without departing from its spirit or characteristics. The described embodiments are to be considered in all respects as only illustrative and not restrictive, and the scope of the invention is, therefore, indicated by the appended claims rather than by the foregoing description. All changes which come within the meaning and range of equivalency of the claims are to be embraced within their scope.

I claim:

1. A toilet seat comprising a) a lower seat member;

b) an upper seat member disposed over the lower seat member, wherein the upper seat member includes a seating surface consisting of a first section and a second section, the first section integrally formed with the lower seat member and the second section removably disposed over the lower seat member, with the second section constituting less than a majority of the seating surface of the upper seat member; and c) an electric motor that is operatively connected to the second section to remove and replace the second section of the upper seat member.

2. A toilet seat comprising a) a lower seat member including a front portion and a rear portion, wherein the lower seat member is substantially oval-shaped;

b) an upper seat member including a first section, a second section, a third section, and a fourth section, the first, second, third and fourth sections being adjacently disposed to form a substantially contiguous seating surface, wherein the first section covers the rear portion of the lower seat member, the second section is removably disposed on the front portion of the lower seat member such that when the second section is removed less than a majority of the seating surface is removed, the third and fourth sections cover the remainder of the front portion of the lower seat member, and the first, third and fourth sections are integrally formed with the lower seat member; and c) a motor that is operatively connected to the second section to remove and replace the section off the lower seat member.

3. A toilet seat for use with an elongated, planar transfer device to transfer a patient from a wheelchair to the toilet seat, the toilet seat consisting essentially of a main seat member and a removable section;

the main seat member comprising a rear section, a front section, an outside edge, an inside edge and a seating surface, the seating surface being on the rear and front sections, the rear section for orientation to a rear portion of a toilet bowl, the front section having a cut-out portion spanning from the inside edge to the outside edge, the cut-out portion having a support surface to support the transfer device placed thereon, the support surface of the cut-out portion being at a predetermined depth below the adjacent seating surface such that when the transfer device is placed in the cut-out portion the top of the transfer device is at about the same elevation as the seating surface; and the removable section disposed in the cut-out portion and covering the support surface of the cut-out portion, the removable section being pivotably connected to the main seating member so as to be removed off of the main seat member by rotating in a common plane as the main seat member to expose the support surface and allow the sliding transfer device to be placed thereon, the removable section having a seating surface presented substantially flush with the adjacent seating surface of the main seat member when the removable section is replaced in the cut-out portion.

4. The toilet seat of claim 3 further in combination with a power aid operatively connected to the removable section to remove and replace the section off the main seat member.

5. The toilet seat of claim 4 wherein the power aid comprises an electric motor.

* * * * *